US005615963A

United States Patent [19]

Kobayashi

[11] Patent Number: 5,615,963

[45] Date of Patent: Apr. 1, 1997

[54] LIQUID APPLICATOR AND METHOD OF MAKING SAME

[75] Inventor: Nobuaki Kobayashi, Nara, Japan

[73] Assignee: Sakura Color Products Corp., Osaka-Fu, Japan

[21] Appl. No.: 233,819

[22] Filed: Apr. 26, 1994

[30] Foreign Application Priority Data

Apr. 27, 1993 [JP] Japan ..... 5-027854 U
Dec. 31, 1993 [JP] Japan ..... 5-352109

[51] Int. Cl.[6] ..... B43K 8/02; B43K 8/04

[52] U.S. Cl. ..... 401/206; 401/199; 401/273

[58] Field of Search ..... 401/198, 206, 401/199, 272, 273

[56] References Cited

U.S. PATENT DOCUMENTS

| | | | |
|---|---|---|---|
| 2,097,496 | 11/1937 | Lunzer | 401/198 X |
| 2,593,599 | 4/1952 | Patch | 401/199 |
| 2,624,902 | 1/1953 | Soldner | 401/206 |
| 2,676,349 | 4/1954 | Vosburg | 401/199 X |
| 3,032,802 | 5/1962 | Kusama | 401/206 |
| 3,044,101 | 7/1962 | Rosenthal | 401/199 |
| 3,088,160 | 5/1963 | Cline | 401/198 |
| 3,278,976 | 10/1966 | Ward | 401/198 |
| 5,082,386 | 1/1992 | Hironaka et al. | 401/206 |
| 5,411,345 | 5/1995 | Ueji et al. | 401/206 |

FOREIGN PATENT DOCUMENTS

| | | | |
|---|---|---|---|
| 200329 | 11/1955 | Australia | 401/206 |
| 0197281 | 10/1986 | European Pat. Off. . | |
| 2058355 | 5/1972 | Germany | 401/273 |
| 8714866 | 12/1987 | Germany . | |
| 9110403 | 10/1991 | Germany . | |
| 121584 | 7/1982 | Japan | 401/206 |
| 1-84779 | 6/1989 | Japan . | |
| 5-32235 | 8/1993 | Japan . | |
| 451059 | 8/1936 | United Kingdom . | |
| 761065 | 11/1956 | United Kingdom | 401/272 |
| 851586 | 10/1960 | United Kingdom . | |
| 1167632 | 10/1969 | United Kingdom . | |
| 1350320 | 4/1974 | United Kingdom . | |
| 2086809 | 5/1982 | United Kingdom . | |
| 2170697 | 8/1986 | United Kingdom . | |

*Primary Examiner*—Steven A. Bratlie
*Attorney, Agent, or Firm*—Wood, Phillips, VanSanten, Clark & Mortimer

[57] ABSTRACT

A liquid applicator having a liquid reservoir, a tip having a polygonal surface to apply liquid in the reservoir to an object, a tip holder, and structure cooperating between the tip holder and reservoir for connecting the tip holder to the liquid reservoir so that the tip holder does not rotate relative to the liquid reservoir.

28 Claims, 14 Drawing Sheets

LIQUID APPLICATOR AND METHOD OF MAKING SAME

BACKGROUND OF THE INVENTION

1. Field of the Invention

The present invention relates to a liquid applicator usable as a writing tool, a paint applicator, a manicure applicator, or a paste applicator, and a method of making the same. More particularly, the present invention relates to a liquid applicator with a tip having a flattened or rectangular cross section, wherein the liquid can be ink, paint, correction ink, manicure, or paste, depending upon the use of the applicator.

2. Background Art

As a typical example of liquid applicators, felt-tipped pens are known and widely used. In recent years, plastic tips have replaced the felt tips. When viscous liquid such as paint and paste is contained, a valve is used so as to facilitate the flow of the liquid. By reference to FIG. 16 herein, a known liquid applicator will be described.

The illustrated pen includes a cylindrical writing tip 100 of plastic. Whether the tip is felt or plastic, the feature in common with the known applicators is that they commonly use a cylindrical tip.

The writing tip 100 is connected to a cylindrical core 101 through which ink flows from a liquid reservoir (not shown) to the writing tip 100. The core 101 is made of liquid permeable material such as a porous substance or a textile bundle. The writing tip 100 and the core 101 are connected to each other by means of a tip holder 102 which consists of a thick trunk portion 105 and a thin branch portion 103. The trunk portion 105 includes an end portion having an inside diameter to closely receive the core 101. The branch portion 103 has an end portion defining an inside diameter to closely receive the writing tip 100. The tip holder 102 is fabricated by machining (cutting). The writing tip 100 is frictionally held in the branch portion 103, and the core 101 is frictionally held in the tank portion 105, of the tip holder 102.

The core 101 secured to the tip holder 102 is inserted in a bore 108 in the coupler 106. The coupler 106 is secured to a liquid reservoir (not shown). Ink flows from the reservoir to the writing tip 100 through the core 101. The flow of the ink is controlled by a valve (not shown).

In use, the draftsman pushes the writing tip 100 against paper. The core 101 is thrust into the bore 108 and opens the valve (not shown) so as to allow ink to flow to the writing tip 100 through the core 101.

There are other known liquid applicators using a valve in a reservoir—one is shown in Japanese Utility Model Publication (allowed) No. 5-32235 and another is shown in Japanese Utility Model Laid-Open Publication (Kokai) No. 1-84779. These liquid applicators also use a cylindrical tip.

In general, cylindrical writing tips raise no problems when used to write ordinary letters and draw ordinary lines, but they are inconvenient in drawing thick lines and/or painting a relatively large area. Therefore, rectangular writing tips have recently been used wherein "rectangular tip" refers generically to a tip whose cross section is flattened. The advantage of a rectangular tip is that the user can use the side faces, ridges, and corner points of the tip unlike a cylindrical tip. By using the corner points and ridges, thick and thin lines can be freely drawn, and a large area can be quickly painted by using the side faces.

In the liquid applicators using a valve, the tip must be pushed against paper to open the valve, but a problem arises when the rectangular tip is pushed, or if the draftsman has a habit of holding the applicator too strongly. In either case the tip is torqued and tends to rotate. While writing letters or drawing lines, an unexpected rotation of the tip may undesirably change the regularity of lines and letters. Particularly in calligraphy the irregular handwriting may be fatal to the calligraphic beauty.

SUMMARY OF THE INVENTION

The present invention is specifically directed to overcoming the above enumerated problems in a novel and simple manner.

In one form of the invention, a liquid applicator is provided having a liquid reservoir, a tip having a polygonal surface to apply liquid in the reservoir to an object, a tip holder, and structure cooperating between the tip holder and reservoir for connecting the tip holder to the liquid reservoir so that the tip holder does not rotate relative to the liquid reservoir.

In one form, the tip holder connecting structure includes a coupler, structure for engaging the tip holder with the coupler, and structure for connecting the coupler to the liquid reservoir.

Keying structure cooperating between the tip and tip holder prevents relative rotation therebetween.

In one form, the polygonal tip surface is rectangular.

The tip may be made from plastic or other material capable of wicking fluid. The tip may include a first portion flint is rectangular in cross section and a second portion that is substantially cylindrical in cross section, as viewed lengthwise of the tip.

The structure for engaging the tip holder with the coupler may include an expanded portion on the tip holder that engages the coupler. The expanded portion can be provided at the front end of the liquid applicator at which the tip resides.

In one form, the tip holder and coupler are engaged so that the tip holder and coupler are relatively slidable but fixed against rotation relative to each other.

The structure for engaging the tip holder with the coupler may include ridges on one of the tip holder and coupler, which ridges extend lengthwise of the liquid applicator. In one form, four such ridges are provided.

In one form, the tip holder has a length and the tip is longer than the tip holder.

The tip holder can be flattened along substantially its entire length.

The tip holder can be made from plastic, metal, or other suitable material.

A valve may be provided to control flow of liquid from the liquid reservoir to the tip. The valve has open and closed states, with structure cooperating between the tip and valve for moving the valve from its closed position into its open position as an incident of the tip being pushed. A core can be provided on the rear of the tip holder to operate the valve. The core can have a cylindrical shape.

In another form of the invention, a liquid applicator is provided having a reservoir for a liquid supply; a tip unit including a tip holder having spaced ends, a tip having a polygonal surface to engage an object at one end of the tip holder, and a core at the other end of the tip holer; a coupler; structure for connecting the coupler to the fluid reservoir; structure cooperating between the tip unit and coupler for slidably engaging the tip holder with the coupler; a valve having an open state and a second state; and structure for connecting the valve to at least one of the reservoir, tip unit and coupler so that the valve can be moved from its second state into its open state by the core and with the valve in its open state, liquid in the reservoir can communicate through the core to the tip.

In another form of the invention, a liquid applicator is provided having a liquid reservoir, a valve on the reservoir to control discharge of liquid from the reservoir and having an open state and a second state, a tip for applying liquid in the reservoir to an object and having a polygonal surface to engage an object, a cylindrical core, and a cylindrical tip holder having spaced ends with the tip being provided at one end of the tip holder and the cylindrical core being provided at the other end of the tip holder, a coupler having an inside surface, structure for connecting the coupler to the liquid reservoir, and structure for engaging the tip holder with the coupler including ridges on the inside surface of the coupler. The tip holder is flattened at one end to define an expanded portion that is engageable with the coupler. The structure for engaging the tip holder with the coupler engages the tip holder and coupler so that the tip holder is slidable but nonrotatable relative to the coupler. The tip holder can be slid relative to the coupler to cause the core to move the valve from the second state into the open state.

The invention flasher contemplates a tip unit for use in a liquid applicator, which tip unit has a tip made at least partially from plastic, a liquid permeable core, and a substantially cylindrical tip holder having an axis and first and second ends, with the tip being at the first end and the core being at the second end of the tip holder. The first tip holder end is flattened to expand radially oppositely with respect to the axis of the tip holder.

The invention further contemplates a method of producing a liquid applicator, which method includes the steps of forming a reservoir for a supply of liquid, forming a coupler having an axis and an inside wall with axially extending ridges along the inside wall, forming a tip having a rectangular cross section, forming a cylindrical tip holder with spaced ends and an axis, flattening one end of the tip holder so that the tip holder has a portion that is expanded in a radial direction, connecting the coupler to the liquid reservoir, and connecting the tip holder to the coupler with the expanded tip holder portion engaging the ridges on the coupler.

The method may also include the steps of forming a core and inserting the core in the other end of the tip holder.

Still further, the method may include the step of forming a valve that can be placed selectively in an open state and a second state and placing the valve on the liquid reservoir so that the valve can control the flow of fluid in the reservoir from the reservoir.

DETAILED DESCRIPTION OF THE PREFERRED EMBODIMENT

Figure 1:
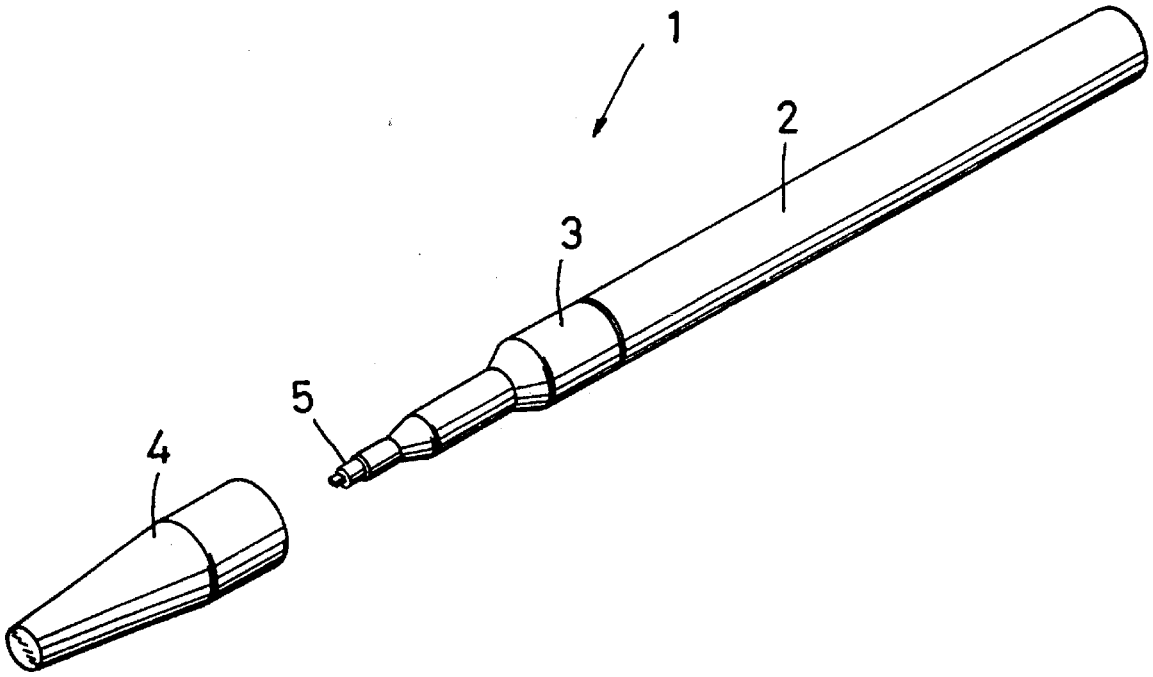
FIG. 1 is a perspective view of a liquid applicator according to the present invention.
Figure 2:
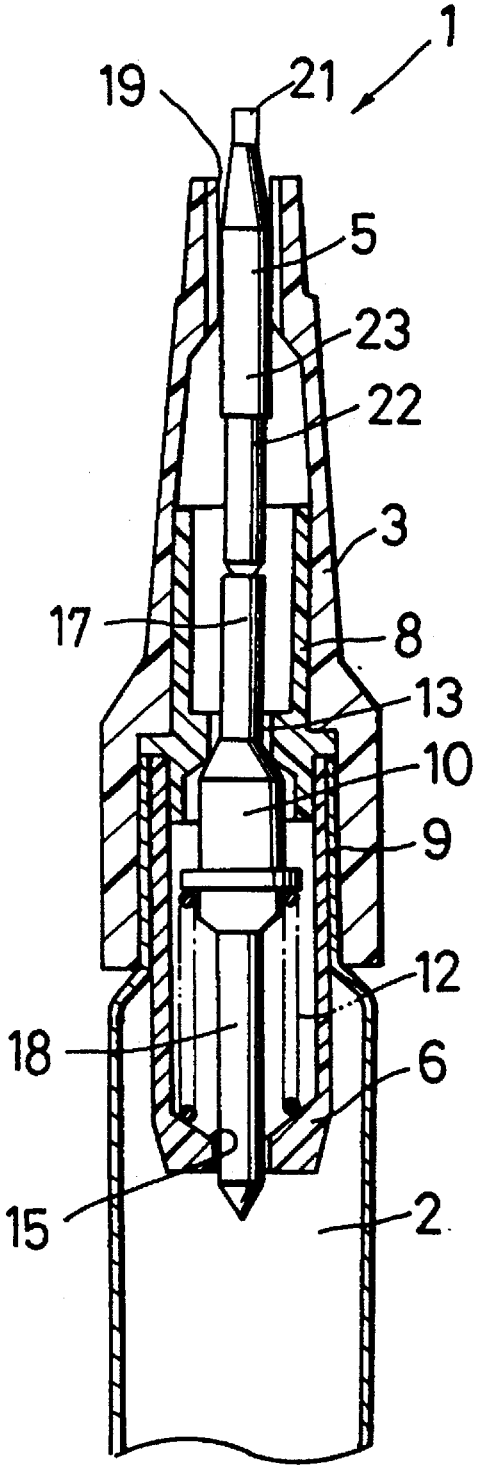
FIG. 2 is a cross-sectional view of the front portion of the liquid applicator of FIG. 1.

Referring to FIGS. 1 and 2, one exemplary liquid applicator 1, according to the invention, includes a liquid reservoir 2 at its rear end, a coupler 3, a tip unit 5 at its front end, and a cap 4. The liquid reservoir 2 is made of aluminum, stainless steel, plastic or glass in a known manner such as by deep drawing, extrusion, blowing or injection. The reservoir 2 can hold not only ink but also paste, manicure, and the like, as the case may be.

The liquid reservoir 2 is provided with a valve 6 made of plastic, which valve 6 includes a valve body 10, a valve seat 8, and a cylindrical frame 9. The seat 8 has a throat (restricted portion) 13 which opens forwardly frown the reservoir 2. The frame 9 is adhered to a necked down portion of the reservoir 2 and is provided with openings (not shown ) through which liquid is allowed to come in and go out of the reservoir 2. The frame 9 has an opening 15 at its rear end. The valve body 10 has thickened center portion, a front abutment head 17 and a rear guide portion 18.

The seat 8 and frame 9 cooperatively define a working space for the valve body 10. The valve body 10 is movable in a fore and aft direction along and within the seat 8 and frame 9, with the abutment head 17 passing through the throat 13 and the guide portion 18 passing through the opening 15 at the rear. The valve body 10 is normally biased by a spring 12 toward the valve seat 8 so as to close the throat 13. When the tip is pushed against paper, the guide portion 18 of the valve body 10 is biased rearwardly toward the reservoir 2 against the force of the spring 12. The body 10 thus unseats at the throat 13.

The coupler 3 closes the reservoir 2 and has an opening 19 whose inside wall has ridges 20 (FIG. 3B) extending lengthwise along the coupler 3 with grooves 28 therebetween. Each ridge 20 has a semi-circular cross section. The number of ridges 20 is optional. In the illustrated embodiment, four ridges are shown. An imaginary circle defined through the peaks of the ridges 20 is slightly larger than the outside diameter of a mink portion 27 (FIG. 4) of a tip holder 23 so that the tip holder 23 can pass through the opening 19 of the coupler 3. The coupler 3 is made of polypropylene by injection molding.

The exemplary liquid applicator 1 is provided with a tip unit 5 which includes, in addition to the tip holder 23 and coupler 3 referred to above, a tip 21 and a core 22. The tip 21 has a polygonal cross section and, preferably, a rectangular cross section, and is made of liquid permeable synthetic resin such as polyacetal. Liquid permeability can be effected by providing the tip 21 with multiple tiny axial grooves or bores or making it with material having tiny grooves or bores therethrough. The liquid such as ink can permeate through the grooves or bores and reach the tip 21. Such grooves can be formed as narrow slits throughout the entire length of the tip 21. One method is to expand a material having bores so that the diameter of each bore is fully reduced.

Figure 3A:
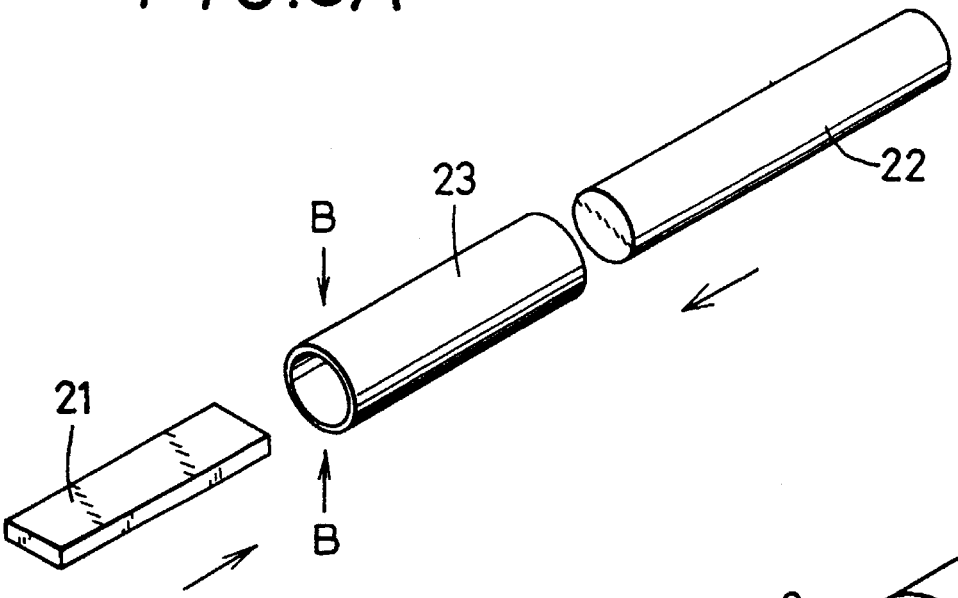
FIG. 3A is an exploded perspective view showing part of a tip unit incorporated into the liquid applicator of FIG. 1.

The core 22 is made of porous plastic or of a fibrous bundle in the form of a bar. The tip holder 23 is made of brass, or other suitable material, substantially in the form of a cylinder throughout its length, as shown in FIG. 3A, and has an inside surface with a diameter dimensioned to closely accept the core 22. The tip holder 23 can be made in a known manner such as by machining, drawing or rolling.

Figure 3B:
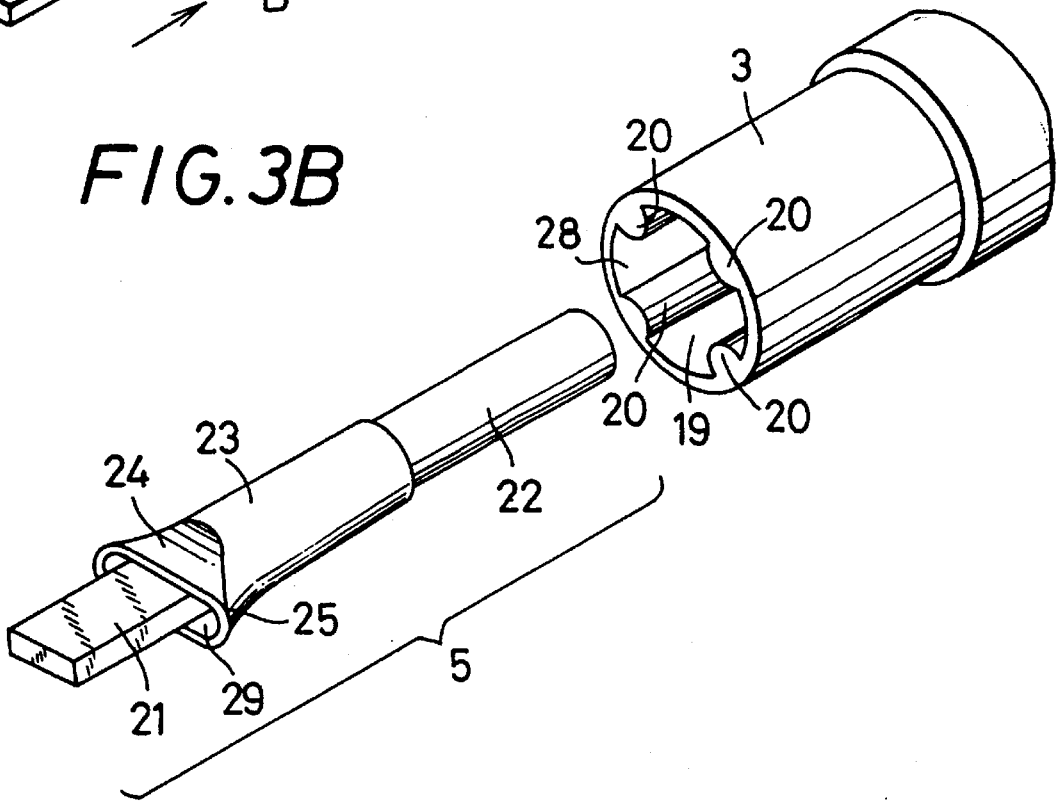
FIG. 3B is an exploded perspective view showing a tip holder on the tip unit of FIG. 3A formed in a first manner according to the invention in relationship to a coupler and a liquid reservoir on the liquid applicator of FIG. 1.
Figure 4:
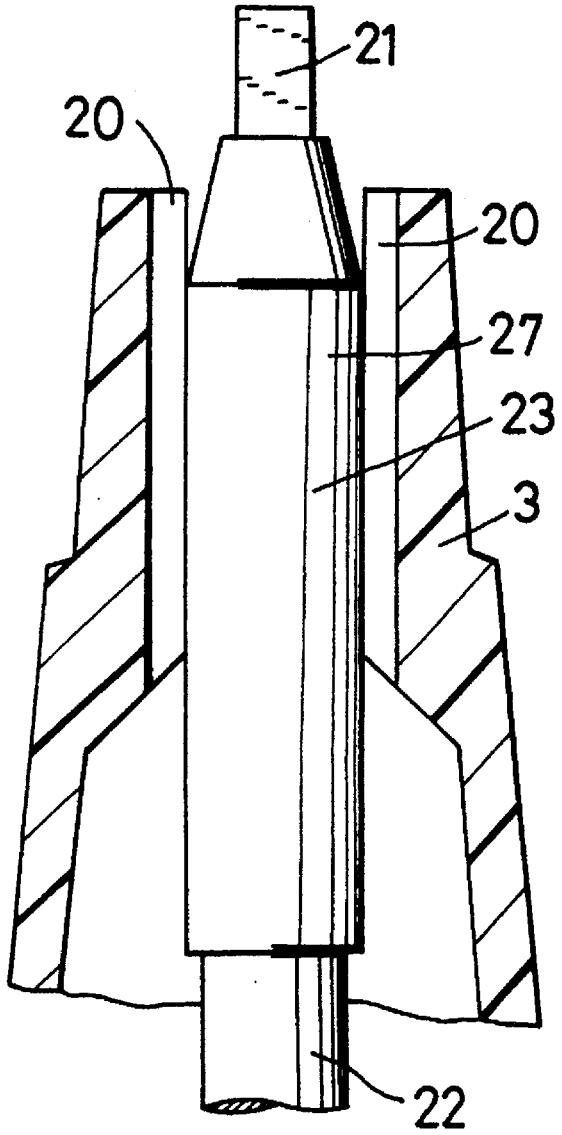
FIG. 4 is an enlarged, partial cross-sectional view of the forward portion of the liquid applicator shown in FIG. 2.
Figure 5:
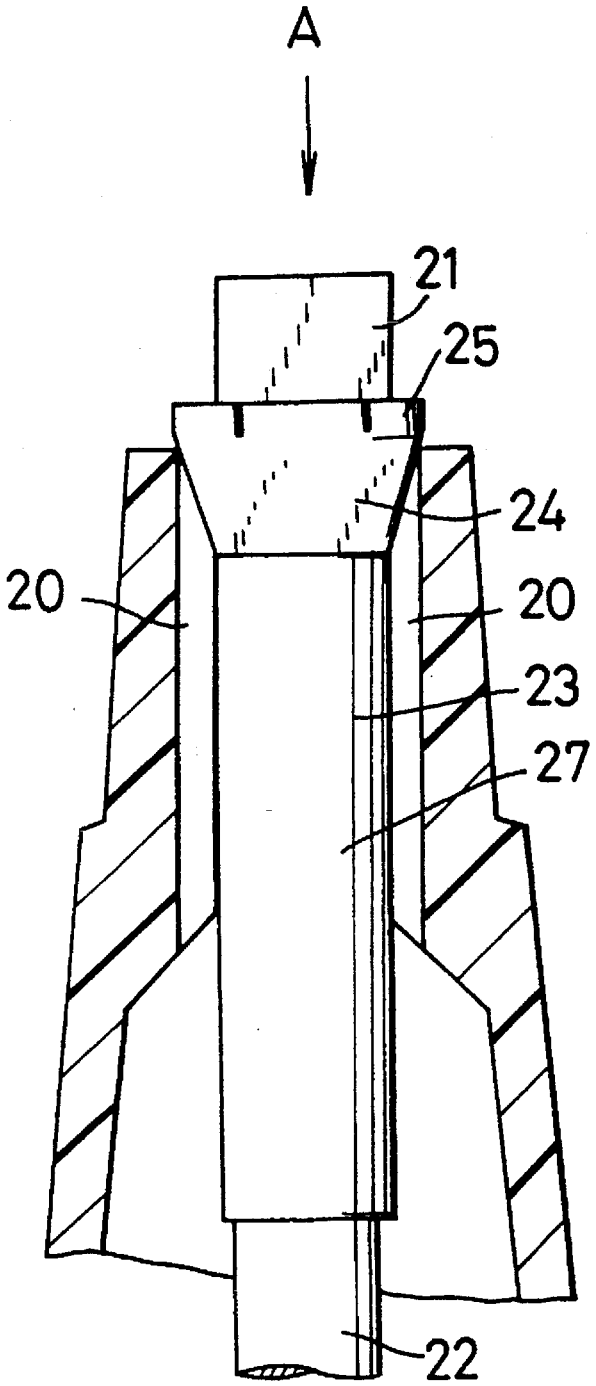
FIG. 5 is an enlarged, partial cross-sectional view of the forward portion of the liquid applicator shown in FIG. 3B.

The tip 21, the core 22 and the tip holder 23 are assembled in the following manner, as seen in FIGS. 3A and 3B, so as to form a part of the tip unit 5. First, the tip 21 is inserted in the front end portion 24 of the tip holder 23, and then the end portion 24 is flattened as by pressing or crushing in the direction of arrows B in FIG. 3A so as to secure the tip 21 against rotation in the flattened end portion 24. The flattened end portion 24 is expanded sideways to form expanded end portions 25 extending radially beyond the outer diameter of the body portion 27.

Figure 6:
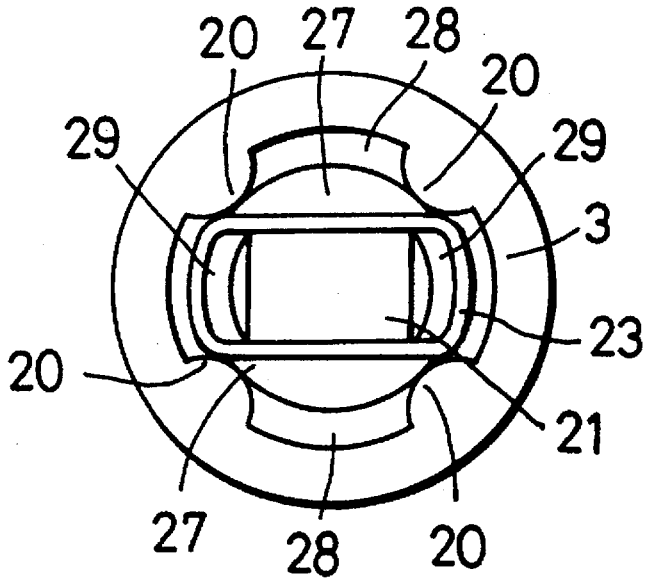
FIG. 6 is an end view of the liquid applicator taken in the direction of the arrow (A) in FIG. 5.

In the liquid applicator 1 of the present invention the tip 21 and the tip holder 23 are connected by deforming the front end of the tip holder 23. The undeformed cross-section of the trunk 27 of the tip holder 23 has a circular shape. The end portion 24 has a flattened, elliptical shape. In FIGS. 3B and 6, the relationship between the flattened end portion 24 and the tip 21, assembled thereto, is shown. The tip 21 is flatter than the hunk portion 27. The flattened end portion 24 is radially wider than the tip 21 and has more rounded end portions 25. The expanded end portions 25 engage the coupler 3 to maintain the tip holder 23 and coupler 3 in assembled relationship.

The core 22 is then pressed forwardly into the opposite (rear) end of the tip holder 23 until it comes into abutment with the tip 21 within the tip holder 23.

In assembling the liquid applicator 1, the coupler 3 is connected to the front end of the reservoir 2, as shown in FIG. 3B. The pre-assembled tip holder 23, tip 21, and core 22 are inserted into the opening 19 of the coupler 3 until the core 22 of the tip unit 5 comes into engagement with the abutment head 17.

At this point, the expanded end portions 25 of the tip holder 23 engage the ridges 20 of the coupler 3. The expanded end portions 25 of the flattened end portion 24 of the tip holder 23 protrude beyond the trunk portion 27 of the tip holder 23 and extend into oppositely facing grooves 28 between the ridges 20. The ridges 20 function as guide rails for guiding sliding movement of tip holder 23 relative to the coupler 3. The ridges 20 and end portions 25 cooperate to prevent rotation between the tip holder 23 and the coupler 3. The tip 21 is in turn keyed to the tip holder 23 so that the tip 21 does not rotate relative to the tip holder 23 or coupler 3.

The coupler 3 is secured to the reservoir 2. The tip unit 5 is coupled to the reservoir 2 through the coupler 3 in such a fashion that the core 22 comes into abutment with the abutment head 17 so as to complete a communicable passage for the liquid from the reservoir 2 to the tip 21. The tip unit 5, and particularly the extended end portions 25 thereon, are slidably held in the coupler 3 without rotation being possible therebetween.

In use for calligraphy, for example, the drafter pushes the tip 21 against paper. The tip 21 and tip holder 23 are pushed into the coupler 3 with the expanded portions 25 being guided slidably in a rearward direction in the opening 19. In pushing the tip 21, the core 22 is moved rearwardly and thereby brought into contact with the abutment head 17 on the valve body 10. At the same time, the throat 13 is moved away from the seat 8, thereby enabling the liquid to flow from the reservoir 2 and be absorbed by and wicked through the core 22. Since the tip 21 is sheathed by the tip holder 23, it is protected against buckling under the force with which the tip 21 is pushed against paper.

Preferably, the periphery of the core 22 is covered with porous material so that the core absorbs the liquid and retains any liquid surplus.

As shown in FIG. 6, the diametrically opposite grooves 28, in which the expanded end portions 25 of the tip holder 23 do not reside, function as air passages, thereby facilitating the flow of liquid.

While the drafter uses the applicator, the tip can be tilted or rotated so as to utilize various writing areas of the rectangular tip. Normally, this would cause a turning torque upon the tip 21. However since the tip holder 23 is held nonrotatably in the coupler 3 by engagement of the expanded end portions 25 with the ridges 20, the tip 21 is prevented from rotation. In this way, the drafter can freely manipulate the tip 21 in accordance with the object to be written and/drawn. That is, the user can engage any desired surface on the periphery of the tip 21 with the object to be marked as to make thin or thick lines.

In addition, the tip 21 is protected by the tip holder 23 against breaking or buckling under any external force acting on the tip 21 so that the liquid passageways inside the tip 21 and core 22 are protected against becoming blocked off through compaction. Thus the tip 21 can continuously receive a supply of the liquid. A relatively long tip 21 can be used under the protection provided by the tip holder 23 and, if required, the tip may be projected even longer so as to avoid interference between the coupler and the paper as with the applicator tipped at a severe angle in use.

Figure 7:
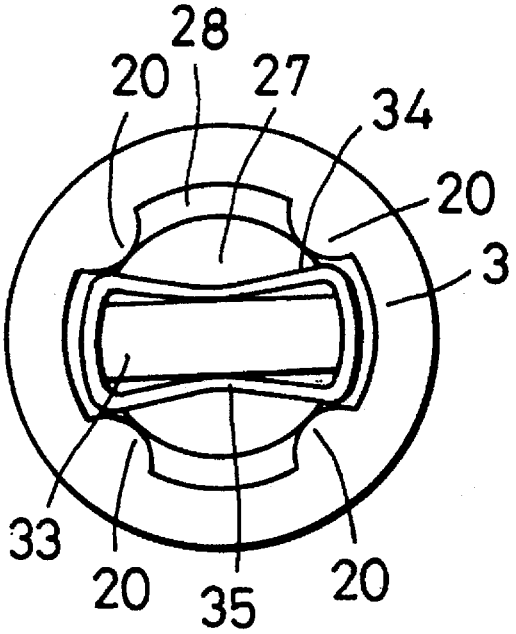
FIG. 7 is a view as in FIG. 6 of a modified form of liquid applicator according to the invention.
Figure 8:
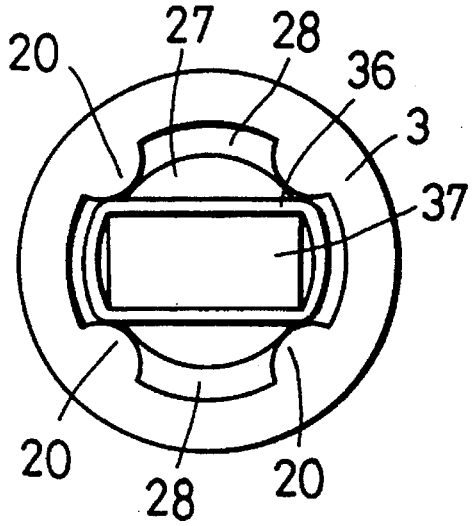
FIG. 8 is a view as in FIGS. 6 and 7 of a further modified form of liquid applicator according to the invention.

Referring to FIGS. 6, 7 and 8, the relationship between the expanded end portions 25 and the coupler 3 will be described. In FIG. 6, the tip 21 is held in the tip holder 23 with spaces 29 on opposite sides of the tip holder 23. The top and bottom sides of the tip 21 are kept in contact with the inside wall of the tip holder 23.

FIG. 7 shows a modification in which a tip holder 34 has inwardly bent portions 35 which are pressed against the tip 33. The opposite sides of the tip 33 are also kept in full contact with the inside wall of the tip holder 34.

FIG. 8 shows another modification in which a tip 37 is held in a tip holder 36 with all sides thereof kept in contact with the inside wall of the tip holder 36. It will be understood from FIGS. 6–8 that the present invention contemplates various types of tips to be carried by the tip holder.

Figure 16:
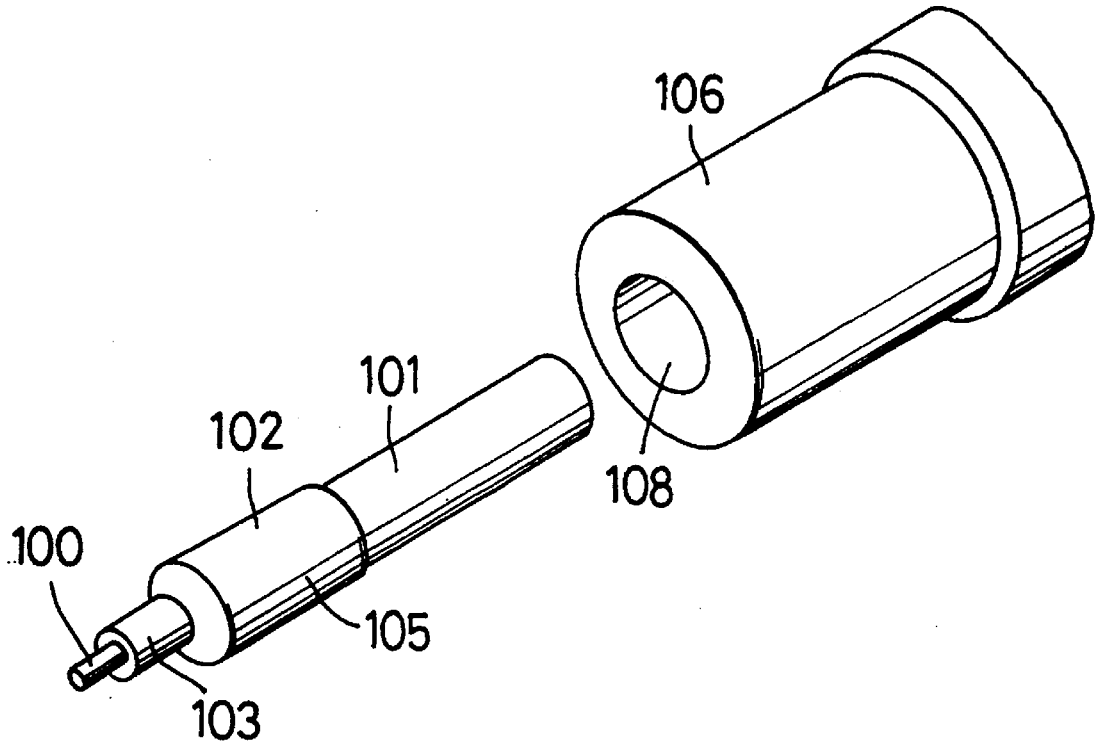
FIG. 16 (PRIOR ART)
FIG. 16 is an exploded perspective view of the front portion of a prior art liquid applicator.

The tip holder can be deformed/flattened after the tip 21 is inserted. It is of course possible to pre-shape the tip holder in various forms to closely conform to the tip. The tip holder is not limited to a type having the same diameter throughout its length, but can be shaped to have a trunk portion, with a large diameter and a thin portion having a small diameter, as shown in FIG. 16.

Figure 10A:
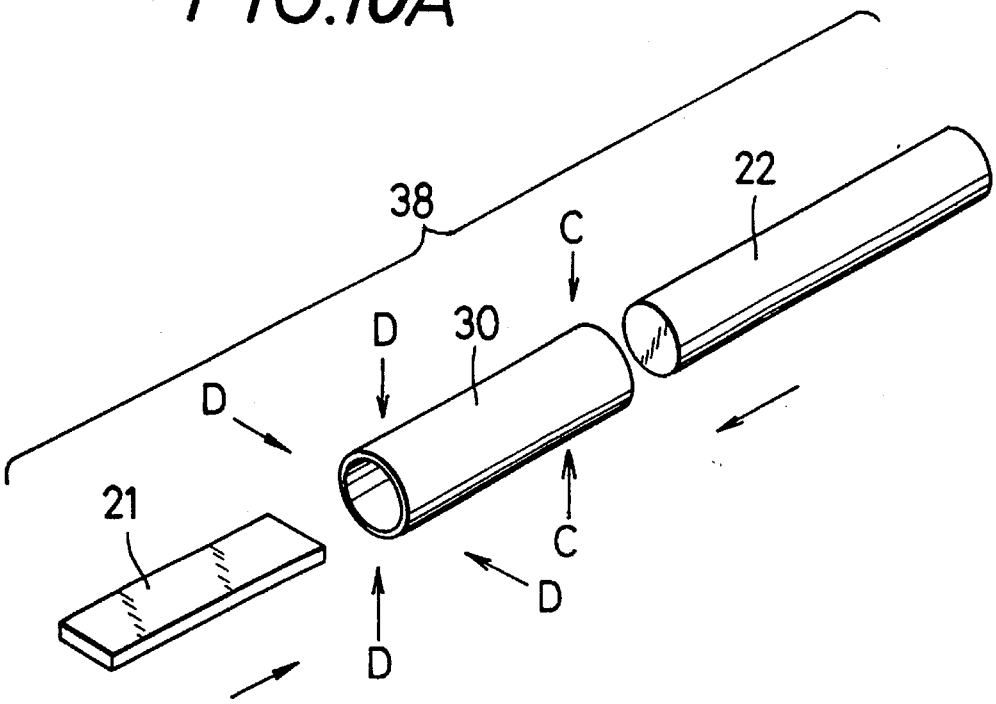
FIG. 10A is an exploded perspective view showing a part of a tip unit to be incorporated into a liquid applicator according to the present invention.
Figure 10B:
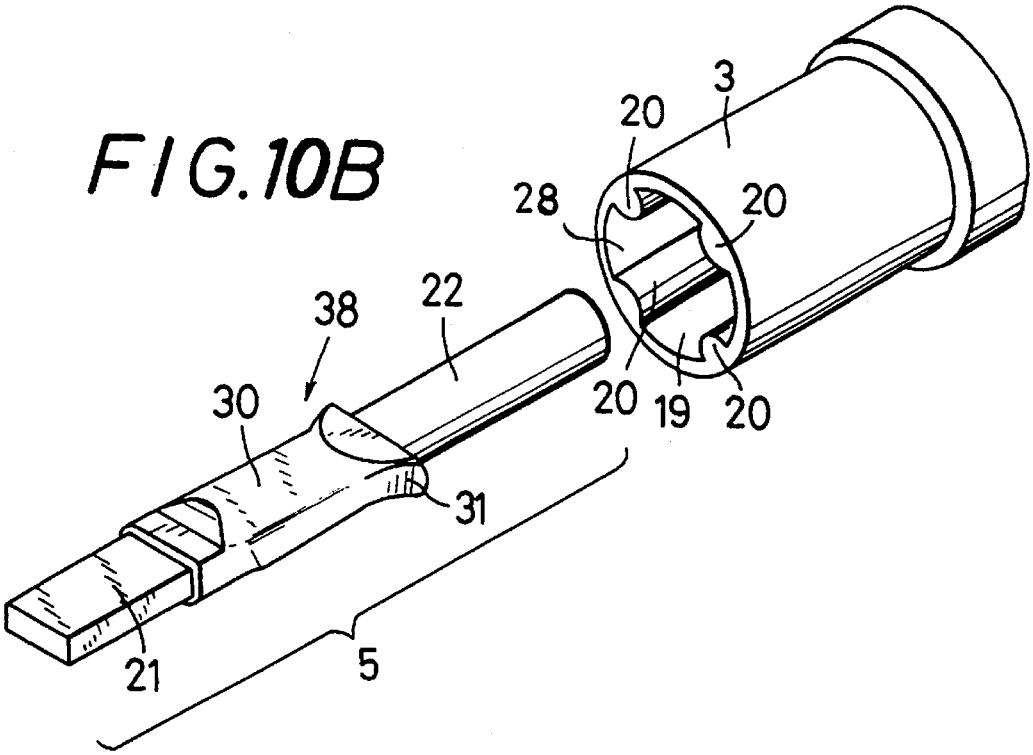
FIG. 10B is an exploded perspective view showing a tip holder on the tip unit of FIG. 3A formed in a different manner according to the invention in relationship to a coupler and liquid reservoir.

The end portion of the tip holder 23 can be flattened in various manners. One suitable manner is shown in FIGS. 10A and 10B, in which the opposite ends of a tip holder 30 are both flattened. The rear end portion of the tip holder 30 is expanded sideways as by pressing simultaneously in the direction of the arrows C. The front end portion is pressed in the four directions indicated by the arrows D. The expanded end portions 31 are inserted in the opening 19 of the coupler 3 and engaged with the ridges 20 thereon.

Figure 9:
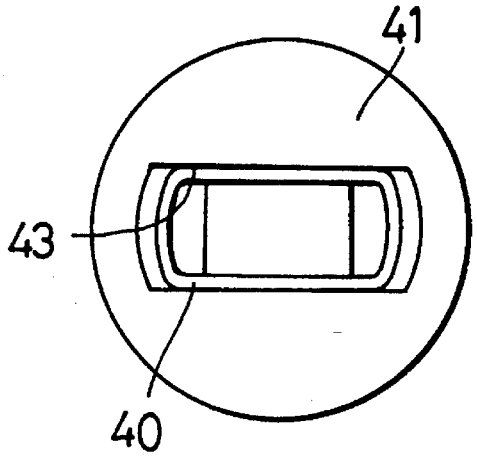
FIG. 9 is a view as in FIGS. 6–8 of a still further modified form of liquid applicator according to the invention.

In one alternative construction, the coupler can be configured to closely accept projecting portions of the tip holder. In another alternative construction, the tip holder is provided with axial grooves, with the coupler having projections engageable in those grooves. Furthermore, as shown in FIG. 9, it is also possible to shape the front end portion of the tip holder in a polygonal form and shape the opening 43 of the coupler 41 in the same polygonal form so as to enable the tip holder and the coupler to be keyed closely to each other.

Figure 11A:
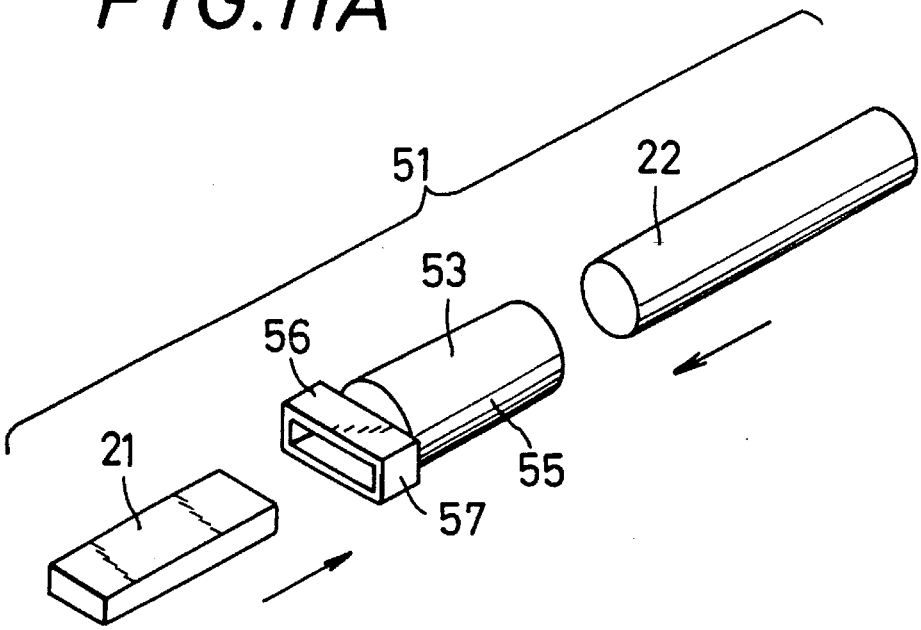
FIG. 11A is an exploded perspective view showing a part of a tip unit with a modified form of tip holder according to the invention.
Figure 11B:
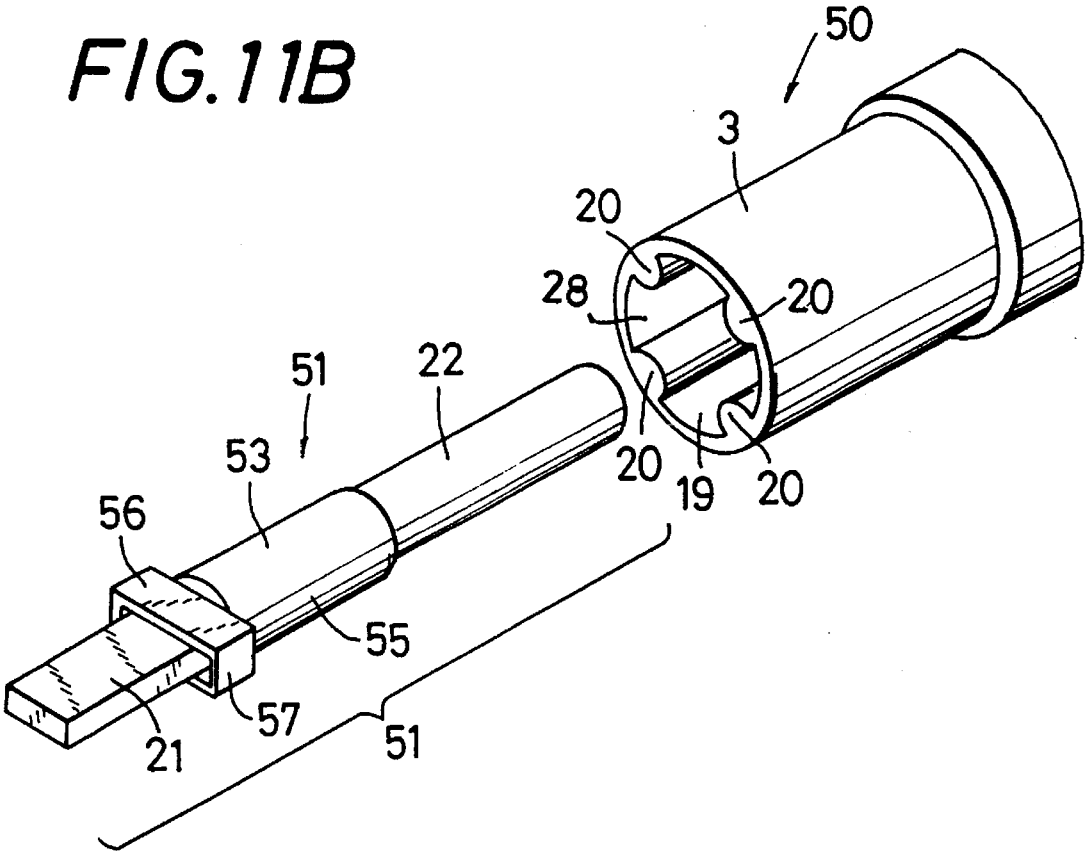
FIG. 11B is an exploded perspective view showing the tip holder part in FIG. 11A assembled and in relationship to a coupler and liquid reservoir.
Figure 12A:
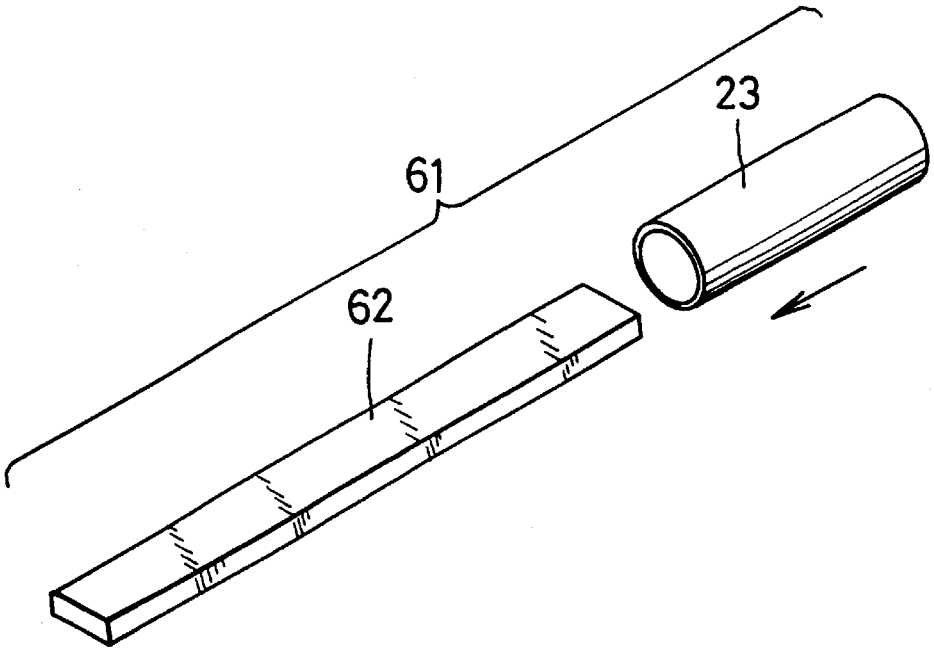
FIG. 12A is an exploded perspective view showing a part of tip unit with a modified form of tip according to the invention.
Figure 12B:
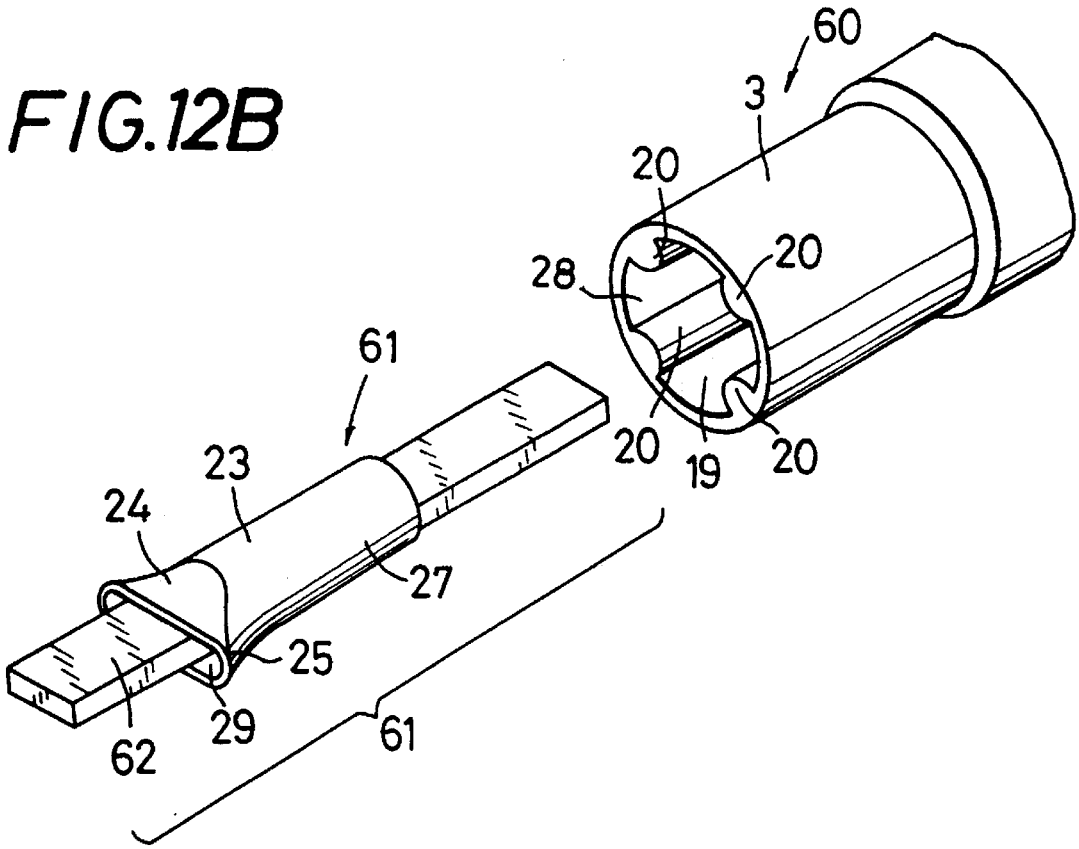
FIG. 12B is an exploded perspective view showing the tip unit part in FIG. 12A with the tip holder thereon deformed and in relationship to a cooperating coupler and liquid reservoir.

In the illustrated embodiments, the tips 21, 33, and 37 and the core 22 are connected to each other through the tip holders 23, 34 and 36, respectively. The tips are securely held by pressing the tips into the end portions of the tip holders. The tip holders can be replaced by a plastic joint member, which will be described by reference to FIGS. 11A and 11B, wherein like numerals refer to like and corresponding parts throughout the drawings and the description thereof will be omitted for simplicity.

The liquid applicator 50 has a tip unit part 51 which has the same structure as in the tip unit 5, previously described. The reservoir 2 is a vessel made of aluminum and has a valve 6 inside. (See FIG. 2). The coupler 3 surrounds the valve body 10. Four ridges 20 are made inside the opening 19. A notable feature of the liquid applicator 50 is in the structure of the tip unit 51, which consists of a connector 53 for connecting a tip 21 and a core 22, both of the latter of which are the same as those used in the aforementioned examples.

The connector 53 is made of plastic such as polypropylene by an injection molding process, and is provided with a frame member 56 secured to a cylindrical body portion 55. The body portion 55 has an inside diameter to accept the outside diameter of the core 22. The tip 21 is brought into contact with the core 22 within the tip holder 53 with the tip 21, core 22 and tip holder 53 in assembled relationship.

The frame member 56 is rectangular and extends sideways beyond the diameter of the body portion 55. The reference numeral 57 denotes the opposite end portions of the frame member 56, which function to engage the coupler 3. The tip unit 51 in this example includes the tip 21 pushed into the frame member 56 of the connector 53. The core 22 is pushed into the cylindrical portion 55 of the connector 53. One end of the tip 21 inside the connector 53 extends rearwardly fully through the frame member 56 into the cylindrical portion 55. Inside the connector 53, the tip 21 touches the core 22. When the tip unit 51 is inserted into the coupler 3, the end portions 57 are engaged with the ridges 20, thereby preventing the tip unit 51 frown rotating within the coupler 3.

Referring to FIGS. 12A, 12B, 13A, and 13B, another modified version of the invention will be described, wherein like numerals refer to like and corresponding parts throughout the drawings and the description thereof will be omitted for simplicity.

This version is different from the embodiments described above, in that no core is used. Instead of the core, a long tip 62 is used which is held by a tip holder 23 having the same structure as the tip holder referred to in the first and second examples, above. The tip 62 is longer than and passes fully through the tip holder 23. The front end of the tip holder is flattened in the same manner as described above, so as to hold the tip 62. The front end of the tip 62 is used as a writing tool, and the other (rear) end is brought into abutment with the abutment head 17 of the valve 10 in the coupler 3. The tip holder 23 carrying the tip 62 is slidable in and along the opening 19 of the coupler while the expanded portions 25 are engaged between the ridges 20, thereby preventing the tip from rotating.

Figure 13A:
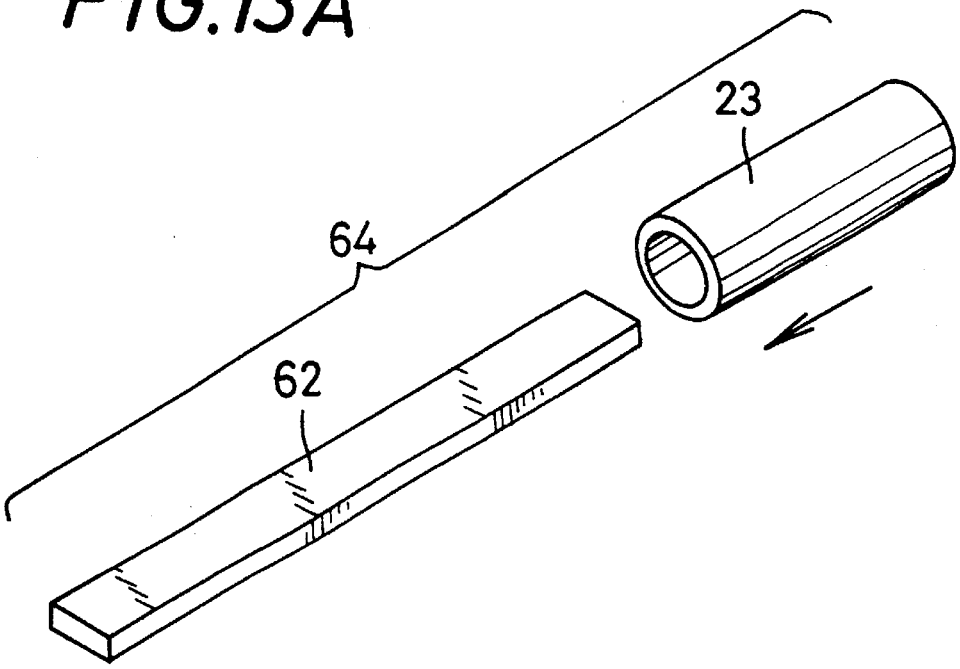
FIG. 13A is an exploded perspective view showing a part of a tip unit as in FIG. 12A.
Figure 13B:
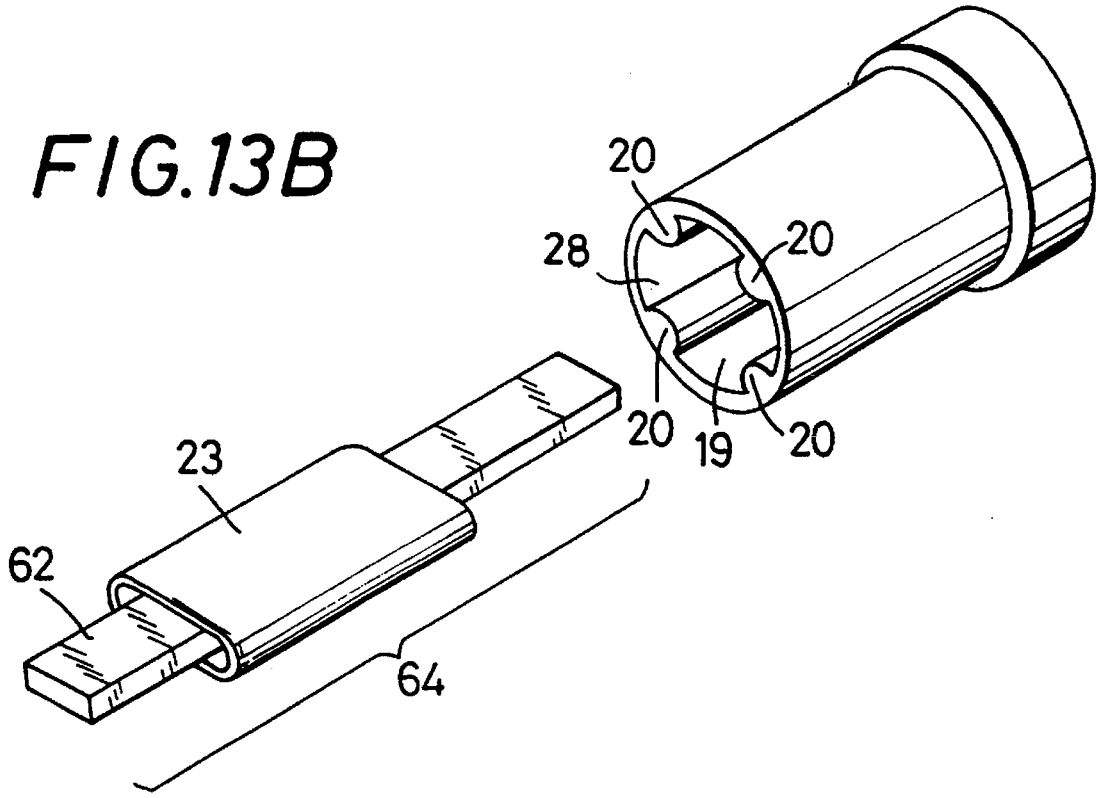
FIG. 13B is an exploded perspective view showing the tip holder in FIG. 13A deformed according to the invention differently than in FIG. 12B.

In flattening the end portion of the tip holder 23, another method can be used as shown in FIGS. 13A and 13B. By this method, the tip holder 23 is flattened along its entire length to hold the long tip 62. A tip unit including the wholly flattened tip holder 23 and the tip 62 is indicated by the reference numeral 64.

Figure 14:
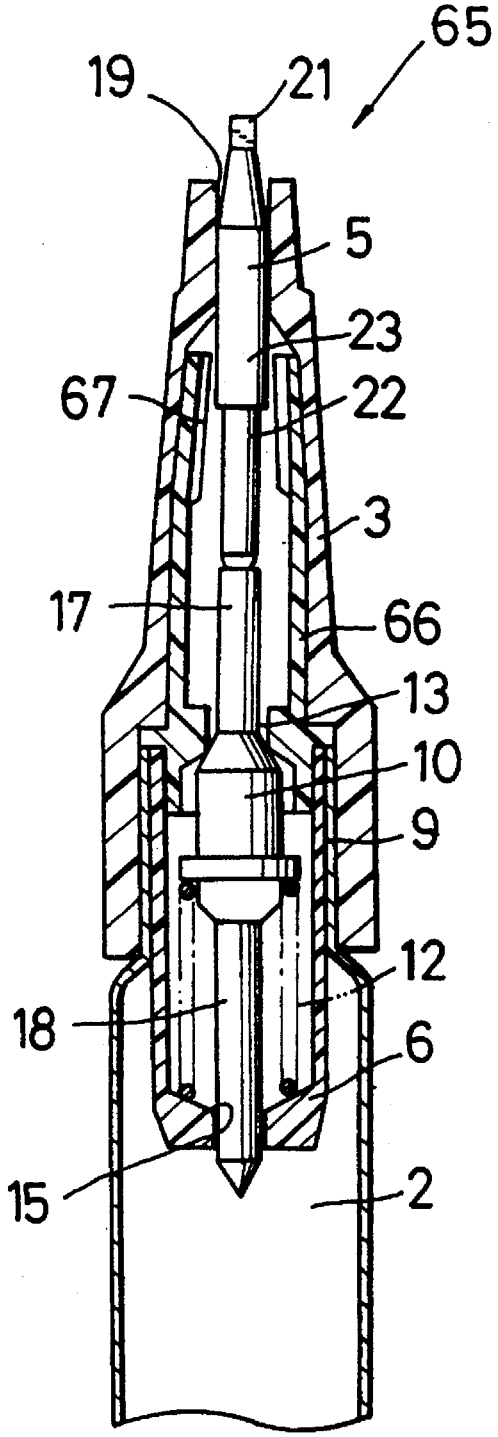
FIG. 14 is a cross-sectional view of the front portion of a modified form of liquid applicator according to the present invention.

It is possible to engage the tip unit 64 shown in FIGS. 13A and 13B and the tip unit 38 shown in FIGS. 10A and 10B other than to the inside surface of a coupler. One alternative arrangement is shown in FIG. 14. In FIG. 14, the liquid applicator 65 includes a valve seat 66 extending along the inside wall of the coupler 3 and terminating near the opening 19. The valve seat 66 has four ridges 67 on an inside wall to receive the tip holder in diametrically opposite grooves between the ridges 67, as shown in FIGS. 6, 7, and 8.

As is evident from the foregoing description, a significant feature of the liquid applicator according to the present invention is that the ridges 20 are provided to produce grooves 28 therebetween which receive the tip or tip holder, thereby preventing the tip from being rotated and becoming buckled under an excessive load. This ridge/groove structure of the coupler is applicable to liquid applicators having any shape tip or pen.

In the writing tool above, the description of the couplers has been mainly to the structure which has four ridges. With the liquid applicator 65 shown in FIG. 14, four ridges 67 are provided in the valve seat 66. The valve seat 66 could have openings to conform to the shape of the tip holder. However, the use of four ridges is most preferable. The reason is that with four ridges, the column part is firmly held, which at the same time makes it possible to axially insert the tip holder without the previously described engaging portions.

Figure 15A:
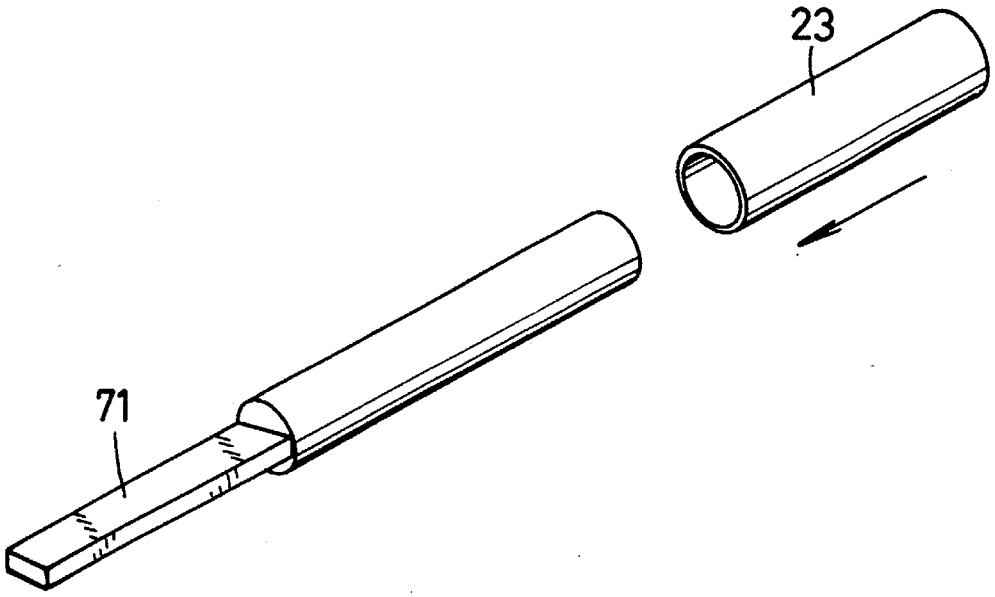
FIG. 15A is an exploded perspective view of a further modified form of a part of a tip unit according to the invention.
Figure 15B:
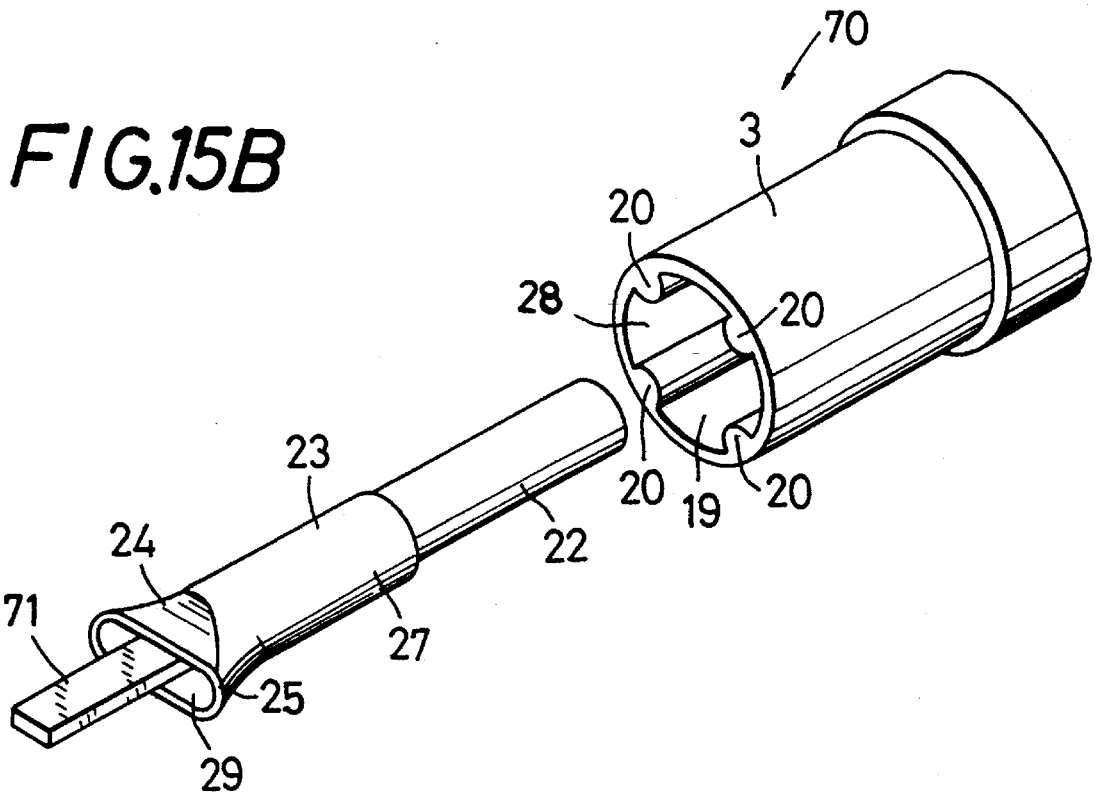
FIG. 15B is an exploded perspective view showing the tip unit part of FIG. 15A assembled and a tip holder thereon deformed and in relation to a cooperating coupler and liquid reservoir.

FIGS. 15A and 15B shows a modified form of tip 71 for use in the liquid applicator according to the present invention. The illustrated tip 71 consists of a rectangular portion and a cylindrical portion which an be matched in cross section to the abutment head 17.

As is evident from the foregoing description, according to the present invention the turning moment exerting on the tip is absorbed by the coupler, thereby ensuring that the tip is prevented from rotation likely to occur when the user manipulates the applicator. In addition, the tip is protected against breaking or buckling under external forces applied to the applicator.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

I claim:

1. A liquid applicator comprising:

a liquid reservoir;

a tip for applying liquid in the reservoir to an object, the tip having a polygonal surface to engage an object;

a tip holder;

keying means cooperating between the tip and the tip holder for preventing relative rotation therebetween; and means cooperating between the tip holder and liquid reservoir for connecting the tip holder to the liquid reservoir so that the tip holder does not rotate relative to the liquid reservoir, the tip holder connecting means including a coupler, means for engaging the tip holder with the coupler, and means for connecting the coupler to the liquid reservoir;

wherein the means for engaging the tip holder with the coupler comprises a flattened portion on the tip holder that engages the coupler.

2. The liquid applicator according to claim 1 wherein the tip comprises plastic.

3. The liquid applicator according to claim 1 wherein the polygonal tip surface is rectangular.

4. The liquid applicator according to claim 1 wherein the means for engaging the tip holder with the coupler includes an expanded portion on the tip holder that frictionally engages the coupler.

5. The liquid applicator according to claim 4 wherein the liquid applicator has front and rear ends with the tip being at the front end and the expanded portion on the tip holder is at the front of the tip holder.

6. The liquid applicator according to claim 1 including a valve for controlling flow of liquid from the liquid reservoir to the tip, said valve having open and closed states, there further being means cooperating between the tip and valve for moving the valve from its closed position into its open position as an incident of the tip being pushed.

7. The liquid applicator according to claim 6 wherein the tip holder has front and rear ends and there is a core at the rear end of the tip holder and the core is engageable with the valve.

8. The liquid applicator according to claim 1 wherein the tip holder has a length and the tip is longer than the tip holder.

9. The liquid applicator according to claim 8 wherein the tip holder is flattened along substantially its entire length.

10. The liquid applicator according to claim 1 wherein the tip has a length and a first portion that is rectangular in cross section taken transversely to its length and a second portion that is substantially cylindrical in cross section taken transversely to its length.

11. The liquid applicator according to claim 1 wherein the tip holder has spaced ends, the tip is at one end of the tip holder and the means for connecting the tip holder to the liquid reservoir includes a core at the other end of the tip holder.

12. The liquid applicator according to claim 1 wherein the tip holder comprises at least one of a plastic and metal material.

13. The liquid applicator according to claim 1 wherein the means for engaging the tip holder with the coupler comprises ridges on one of the coupler and tip holder.

14. The liquid applicator according to claim 13 wherein the liquid applicator has a length and the ridges are on the coupler and extend lengthwise of the liquid applicator.

15. The liquid applicator according to claim 14 wherein there are four ridges extending lengthwise of the liquid applicator.

16. The liquid applicator according to claim 1 wherein the means for engaging the tip holder with the coupler comprises means for engaging the tip holder with the coupler so that the tip holder and coupler are relatively slidable but fixed against rotation.

17. A liquid applicator comprising:

a reservoir for a liquid supply;

a tip unit including a tip holder having spaced ends, a tip having a polygonal surface to engage an object at one end of the tip holder and a core at the other end of the tip holder;

a coupler;

means for connecting the coupler to the reservoir;

means cooperating between the tip unit and coupler for slidably engaging the tip holder with the coupler, said means cooperating between the tip unit and coupler including a flattened portion on the tip holder that is engageable with the coupler;

a valve having an open state and a second state; and means for connecting the valve to at least one of the reservoir, tip unit and coupler so that the valve can be moved from its second state into its open state by the core, whereby with the valve in its open state liquid in the reservoir can communicate through the core to the tip.

18. The liquid applicator according to claim 17 wherein the polygonal surface is rectangular.

19. The liquid applicator according to claim 17 wherein the core is cylindrical.

20. The liquid applicator according to claim 17 wherein the means cooperating between the tip unit and coupler comprises means for nonrotatably engaging the tip holder and coupler.

21. The liquid applicator according to claim 17 wherein the valve has means thereon for receiving a portion of the tip holder.

22. A liquid applicator comprising:

a liquid reservoir;

a valve on the reservoir to control discharge of liquid from the reservoir and having an open state and a second state;

a tip for applying liquid in the reservoir to an object;

the tip having a polygonal surface to engage an object;

a cylindrical core;

a cylindrical tip holder having spaced ends with the tip being provided at one end of the tip holder and the cylindrical core being provided at the other end of the tip holder;

a coupler having an inside surface;

means for connecting the coupler to the liquid reservoir; and means for engaging the tip holder with the coupler so that the tip holder is slidable but nonrotatable relative to the coupler, said means for engaging the tip holder with the coupler including ridges on the inside surface of the coupler, and said tip holder defining an expanded portion at one end that is engageable with the coupler, whereby the tip holder can be slid relative to the coupler to cause the core to move the valve from its second state into its open state.

23. A tip unit for use in a liquid applicator, said tip unit comprising:

a tip;

a liquid permeable core; and a substantially cylindrical tip holder having an axis and first and second ends with the tip being at the first end of the tip holder and the core being at the second end of the tip holder, said tip holder including means for mating with a liquid applicator for sliding, nonrotating movement, said mating means including a portion at said first end that is flattened to expand radially oppositely with respect to the axis of the tip holder, said flattened portion being engageable with a liquid applicator.

24. The tip unit according to claim 23 wherein the tip has a rectangular cross section.

25. The tip unit of claim 23 wherein the tip is made from plastic.

26. A method of producing a liquid applicator, said method comprising the steps of:

forming a reservoir for a supply of liquid;

forming a coupler having an axis and an inside wall with axially extending ridges along the inside wall;

forming a tip having a rectangular cross section;

forming a cylindrical tip holder with spaced ends and an axis;

flattening one end of the tip holder so that the tip holder has a portion that is expanded in a radial direction;

connecting the coupler to the liquid reservoir so that the expanded portion of the tip holder engages the coupler; and connecting the tip holder to the coupler with the expanded tip holder portion engaging the ridges on the coupler.

27. The method of producing a liquid applicator according to claim 26 further including the steps of forming a core and inserting the core in the other end of the tip holder.

28. The method of producing a liquid applicator according to claim 27 including the step of forming a valve that can be placed selectively in an open state and a second state and placing the valve on the liquid reservoir so that the valve can control the flow of fluid in the reservoir from the reservoir.

* * * * *